United States Patent [19]

Siljekvist et al.

[11] Patent Number: 4,912,842

[45] Date of Patent: Apr. 3, 1990

[54] METHOD AND DEVICE TO SHAPE A BRAIDED SHEATH IN A CABLE CONSISTING OF AN OUTER COVERING, A BRAIDED SHEATH AND CONDUCTORS

[75] Inventors: Sven S. Siljekvist, Saltsjö-Boo; Alois A. Bühler, Skärholmen; Kjell O. Hansson, Sollentuna; Karl B. Uvelius, Malmö, all of Sweden

[73] Assignee: Nokia Data Systems AB, Stockholm, Sweden

[21] Appl. No.: 364,584

[22] Filed: Jun. 12, 1989

Related U.S. Application Data

[63] Continuation of Ser. No. 124,113, filed as PCT SE87/00106 on Mar. 4, 1987, published as WO87/05752 on Sept. 24, 1987, abandoned.

[30] Foreign Application Priority Data

Mar. 11, 1986 [SE] Sweden ..... 8601134

[51] Int. Cl.[4] ..... H01R 43/00

[52] U.S. Cl. ..... 29/825; 72/318

[58] Field of Search ..... 29/825, 828; 72/318; 439/930

[56] References Cited

U.S. PATENT DOCUMENTS

| | | | |
|---|---|---|---|
| 3,301,033 | 1/1967 | Bignell et al. | 72/318 X |
| 3,396,567 | 8/1968 | Bachmann | 72/318 |
| 4,719,697 | 1/1988 | Schwartzman | 29/828 X |

*Primary Examiner*—Carl J. Arbes

*Attorney, Agent, or Firm*—Burns, Doane, Swecker & Mathis

[57] ABSTRACT

A method and a device for the formation of the braided sheath on a cable in such a way that the sheath when mounted in such as a connection box gives good contact with the casing of the box.

4 Claims, 1 Drawing Sheet

METHOD AND DEVICE TO SHAPE A BRAIDED SHEATH IN A CABLE CONSISTING OF AN OUTER COVERING, A BRAIDED SHEATH AND CONDUCTORS

No. 07/124113, filed as PCT SE87/00106 on Mar. 4, 1987, published as WO87/05752 on Sept. 24, 1987, now abandoned.

TECHNICAL FIELD

The invention relates to a method and a device in such as telecommunication or electric power systems for the formation of the braided sheath on a cable in such a way that the sheath when mounted in such as a connection box gives good contact with the casing of the box.

BACKGROUND ART

In previously known solutions, the braiding is undone manually into its separate wires. The wires are then put together and twisted into a thick sheath conductor. The sheath conductor is then connected to such as an electrically conducting casing with the aid of soldering or screwing.

DISCLOSURE OF THE INVENTION

The known method of undoing the sheath braiding into its separate wires is thus performed manually and will therefore be time- and work-consuming as well as unfavourable as far as cost is concerned. Furthermore, there is risk of the braiding wires being torn off so that a poorer contact is obtained on connecting the sheath.

The method and device which solve the problems mentioned are characterized by the claim and involve that a braided sheath in an end of a cable is exposed and compressed together into a collar-shaped portion with the aid of a device comprising a die provided with a cavity and a punch displaceable in this cavity.

The compression takes place with a force such that the wires of the braided sheath are compressed into a compact mass without damaging the conductors.

By the method and device in accordance with the invention there is obtained a collar shaped sheath part which is easy to connect and gives good contact with an electrically conducting casing. In addition, the forming process can be done by machine without risk of the sheath wires being damaged. The automatized process also results in large advantages in respect of time and cost.

BRIEF DESCRIPTION OF DRAWINGS

The method and device in accordance with the invention will now be described in detail with the aid of an embodiment and with reference to the accompanying drawing, on which

BEST MODE FOR CARRYING OUT THE INVENTION

The embodiment describes a method and a device for shaping a braided sheath associated with a cable. The exemplified cable is a telephony cable comprising insulated conductors surrounded by a braided sheath and an outer covering. The cable may be a connection between two terminals in a computer system, for example.

Figure 1:
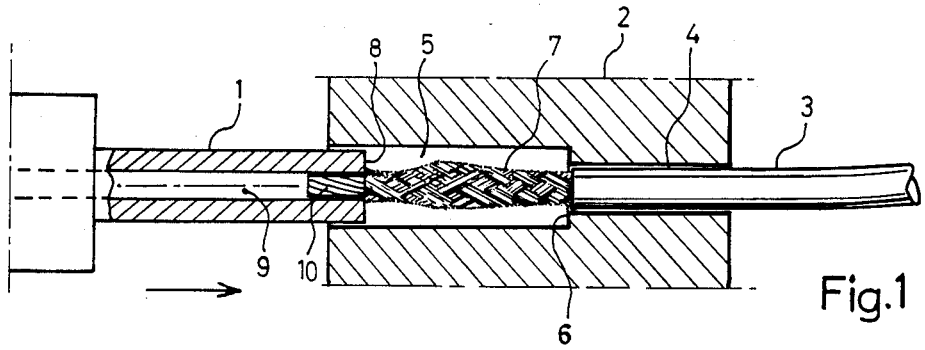
FIG. 1 illustrates the device in accordance with the invention before the braided sheath is pressed together.

As will be seen from FIG. 1, a device in accordance with the invention comprises a punch 1 and a die 2, there being a cable 3 accommodated in a through-hole in the die.

A first space 4 of this hole has a diameter somewhat larger than that of the cable to allow its insertion. A second space 5 in the through-hole has a diameter which is larger than the diameter of the first space 4. The junction between the first space 4 and the second space 5 is taking place along a shoulder 6 having a flat surface which, according to the example, is at right angles to said through hole.

It is of course possible for the shoulder 6 to have another angle in relation to said through-hole.

The cable 3 placed in the hole is in that part comprising said second space 5 removed from its covering so that the braided sheath 7 is exposed.

The punch 1, which has a cylindrical shape and a flat end surface 8, is intended to glide into said second space 5. In its longitudinal direction the punch 1 has a central hole 9 with a diameter at least corresponding to the total diameter of the conductors 10 without the sheath.

Figure 2:
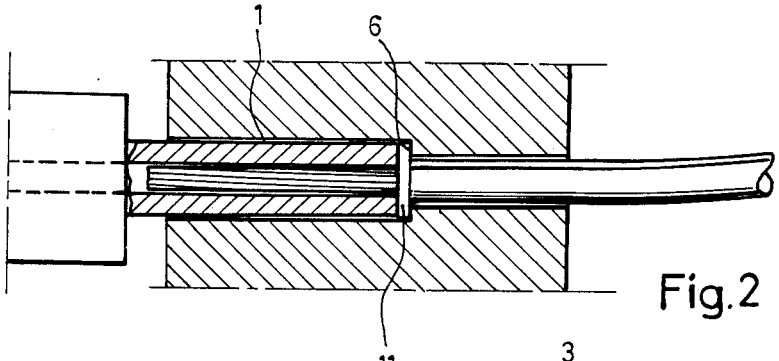
FIG. 2 illustrates the braided sheath compressed into a collar in accordance with the invention.

An operational sequence in accordance with the invention will now be described with reference to FIG. 1, which shows how the cable with its covering removed is placed in the die 2 and how the punch 1 of the device is moved into the second part 5 of the die simultaneously as the conductors 10, being liberated from the sheath, glide into the central hole 9 of the punch. The punch 1 presses the sheath 7 against the shoulder 6 of the die under great pressure, the wires of the sheath thus metalically "floating" together to form a compact collar-shaped portion 11, as will be seen in FIG. 2, which illustrates how the punch 1 has pressed the sheath against the shoulder 6.

Figure 3:
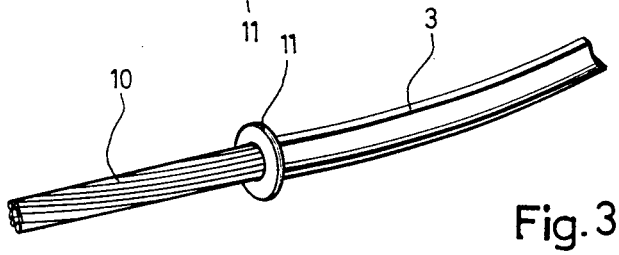
FIG. 3 is a perspective view of the compressed braided sheath.

FIG. 3 illustrates the cable end 3 in perspective with the sheath compressed into a compact collar-shaped portion 11 with the exposed conductors 10.

Figure 4:
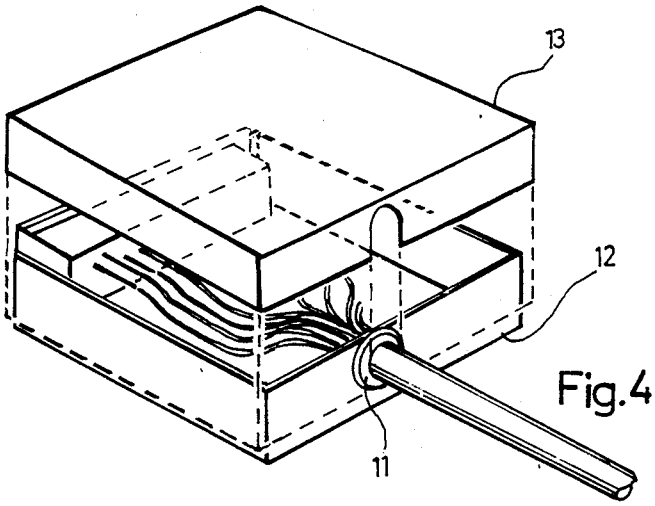
FIG. 4 is an example of how to connect the braided sheath to an electrically conducting casing in a connection device.

FIG. 4 illustrates an application where the sheath pressed into a collar 11 is connected to an electrically conducting casing in a connection device. The casing consists of two parts, one part formed as a box 12 with edges, and the other part formed as a cover 13, which surrounds the edges of the box. In one of the sides of the casing there is a hole through which the cable can be inserted. The collar-shaped sheath connects to the casing by being placed between the edge of the box and the side of the cover.

A braided sheath formed in accordance with the invention may of course be connected to an electrically conducting casing in other applications than in the one described above.

The punch of the device can be formed to prevent the sheath from being pressed into the cable during compression. One embodiment is to provide the flat end of the punch with a projecting circular lip round the opening of the central hole. The lip glides between the cable conductors and the sheath during compression. Another embodiment is to provide the flat end of the punch with a protruding tube round the opening of the central hole such that during compression this tube is thrust in between the sheath and the cable conductors.

It is also possible to vary the shape of the collar, such as to be round, oval, rectangular, swollen etc, by giving the die and the punch, respectively, a configuration such as to agree with the desired collar shape.

We claim:

1. In a cable consisting of an outer covering, a braided sheath and conductors, and proximate the end of which the outer covering is removed, a method of compressing a portion of said braided sheath thus exposed into a collar shape portion, comprising the steps of:

inserting said end of the cable into a through-hole in a die having a shoulder that divides said through-hole into a first space that only permits passage of the cable end and into a second space that in comparison with said first space is enlarged and surrounds said exposed braided sheath; and moving a pressure means into said second space, the conductor at the same time gliding into a hole in the pressure means, said pressure means being arranged to press the braided sheath against said shoulder until the braided sheath is compressed into a compact collar-shaped portion.

2. In a cable consisting of an outer covering, a braided sheath and conductors, and proximate the end of which the outer covering is removed, a device for compressing a portion of said braided sheath thus being exposed into a collar-shaped portion, comprising:

a die with a through-hole having in a first part of its length a first space with an inner configuration corresponding to the outer configuration of the cable for enabling passage of the cable, and in an adjacent second part of its length having a second space with an inner configuration greater than the inner configuration of said first space; and a punch constituting a pressure means with an outer configuration such that it can glide into said second space, said punch having a central hole in which conductors liberated from the sheath can glide, and said punch on its movement into said second space pressing the sheath against a stepped shoulder in the passage between said first space and said second space.

3. Device as claimed in claim 2, wherein said punch is provided at its end with a circular lip, which during compression of the sheath is inserted between the sheath and the conductors of the cable so as to prevent the sheath from being pressed into the conductors.

4. Device as claimed in claim 2, wherein said punch is provided at its end with a tube, which during compression of the sheath is inserted between the sheath and the conductors of the cable so as to prevent the sheath from being pressed into the conductors.

* * * * *